US005767882A

United States Patent [19]

Kaplinsky et al.

[11] Patent Number: 5,767,882

[45] **Date of Patent: *Jun. 16, 1998**

[54] COLLAPSIBLE INK RESERVOIR STRUCTURE AND PRINTER INK CARTRIDGE

[75] Inventors: George T. Kaplinsky, San Diego; David W. Swanson, Escondido; Tofigh Khodapanah, San Diego, all of Calif.; James E. Clark, Albany, Oreg.

[73] Assignee: Hewlett—Packard Company, Palo Alto, Calif.

[ * ] Notice: The term of this patent shall not extend beyond the expiration date of Pat. No. 5,280,300.

[21] Appl. No.: 240,297

[22] Filed: May 9, 1994

Related U.S. Application Data

[63] Continuation of Ser. No. 929,615, Aug. 12, 1992, abandoned.

[51] Int. Cl.[6] ..... B41J 2/175

[52] U.S. Cl. ..... 347/87

[58] Field of Search ..... 346/140 R, 75; 347/87, 86, 85

[56] References Cited

U.S. PATENT DOCUMENTS

| | | | |
|---|---|---|---|
| 4,422,084 | 12/1983 | Saito . | |
| 4,703,332 | 10/1987 | Crotti et al. . | |
| 4,992,802 | 2/1991 | Dion et al. . | |
| 5,103,243 | 4/1992 | Cowger | 347/87 |
| 5,280,300 | 1/1994 | Fong et al. | 347/87 |
| 5,359,353 | 10/1994 | Hunt et al. | 347/86 |
| 5,448,818 | 9/1995 | Scheffelin et al. | 347/86 |
| 5,450,112 | 9/1995 | Scheffelin | 347/87 |

FOREIGN PATENT DOCUMENTS

| | | | |
|---|---|---|---|
| 204569 | 11/1984 | Japan . | |
| 158460 | 7/1986 | Japan | 347/86 |

*Primary Examiner*—N. Le
*Attorney, Agent, or Firm*—David S. Romney

[57] ABSTRACT

A collapsible ink reservoir structure (25) to facilitate assembly of a replaceable or refillable printer ink cartridge is comprised of a relatively rigid frame (20) and flexible membranes (22, 24) forming an ink reservoir having side walls which collapse to a substantially flat shape to minimize the amount of ink remaining in the reservoir structure after computer generated printing has depleted the ink from the cartridge. The structure (25) is a separate unit which is assembled and mounted in an outer housing (10) to form an ink cartridge. The structure preferably contains an ink pressure regulator (30) which maintains a negative pressure therein.

24 Claims, 2 Drawing Sheets

COLLAPSIBLE INK RESERVOIR STRUCTURE AND PRINTER INK CARTRIDGE

BACKGROUND OF THE INVENTION AND PRIOR ART

This is a continuation of copending application Ser. No. 07/929,615 filed on Aug. 12, 1992, now abandoned.

The present invention relates generally to ink cartridges for high speed computer driven printers such as inkjet printers and plotters. In such printers the ink reservoir is ordinarily maintained under a sub-atmospheric or negative pressure so that ink will not leak or drool from the printhead. Various types of ink reservoirs may be used including refillable ink reservoir cartridges which are mounted on the moveable printer carriage, throwaway replaceable cartridges which are mounted on the printer carriage and remote or offboard ink reservoirs from which ink is drawn to the print head by tubing. In the onboard refillable or throwaway cartridges, a polymer foam is ordinarily provided in the ink reservoir so that the capillary action of the foam will prevent ink from drooling from the printhead. Polymeric foams of the type typically used for this purpose are non-biodegradable and thus cause environmental problems whenever a previously used cartridge is emptied and thrown away. In addition, the use of industrial foam in the ink reservoir restricts the operating pressure range of the ink cartridge and such foams ordinarily leave a chemical residue which is incompatible with and/or reacts adversely with printer ink. Similarly, the relatively long tubing used to convey ink from an offboard pressure reservoir to a printing head does not lend itself well for different printing pressure ranges.

It is accordingly an object of the present invention to provide a collapsible ink reservoir structure and a printer ink cartridge containing it which is easy to construct and which obviates the above difficulties.

SUMMARY OF THE INVENTION

The present invention accordingly provides an ink reservoir structure for a printer ink cartridge in which ink is to be maintained under negative pressure and an ink print head in fluid communication with said reservoir structure, said structure comprising:

a) a rigid frame having a pair of peripherally extending edges on opposite sides thereof and an ink discharge port;

b) a pair of flexible impervious membranes sealingly joined to said edges of said frame to form, with said frame, said ink reservoir structure.

The present invention further provides a printer ink cartridge comprising: a rigid housing containing an ink reservoir structure in which ink is to be maintained under negative pressure and an ink print head in fluid communication with said reservoir structure, said structure comprising:

a) a rigid frame having a pair of peripherally extending edges on opposite sides thereof and an ink discharge port;

b) a pair of flexible impervious membranes sealingly joined to said edges of said frame to form, with said frame, said ink reservoir structure.

DESCRIPTION OF THE PREFERRED EMBODIMENT

Figure 1:
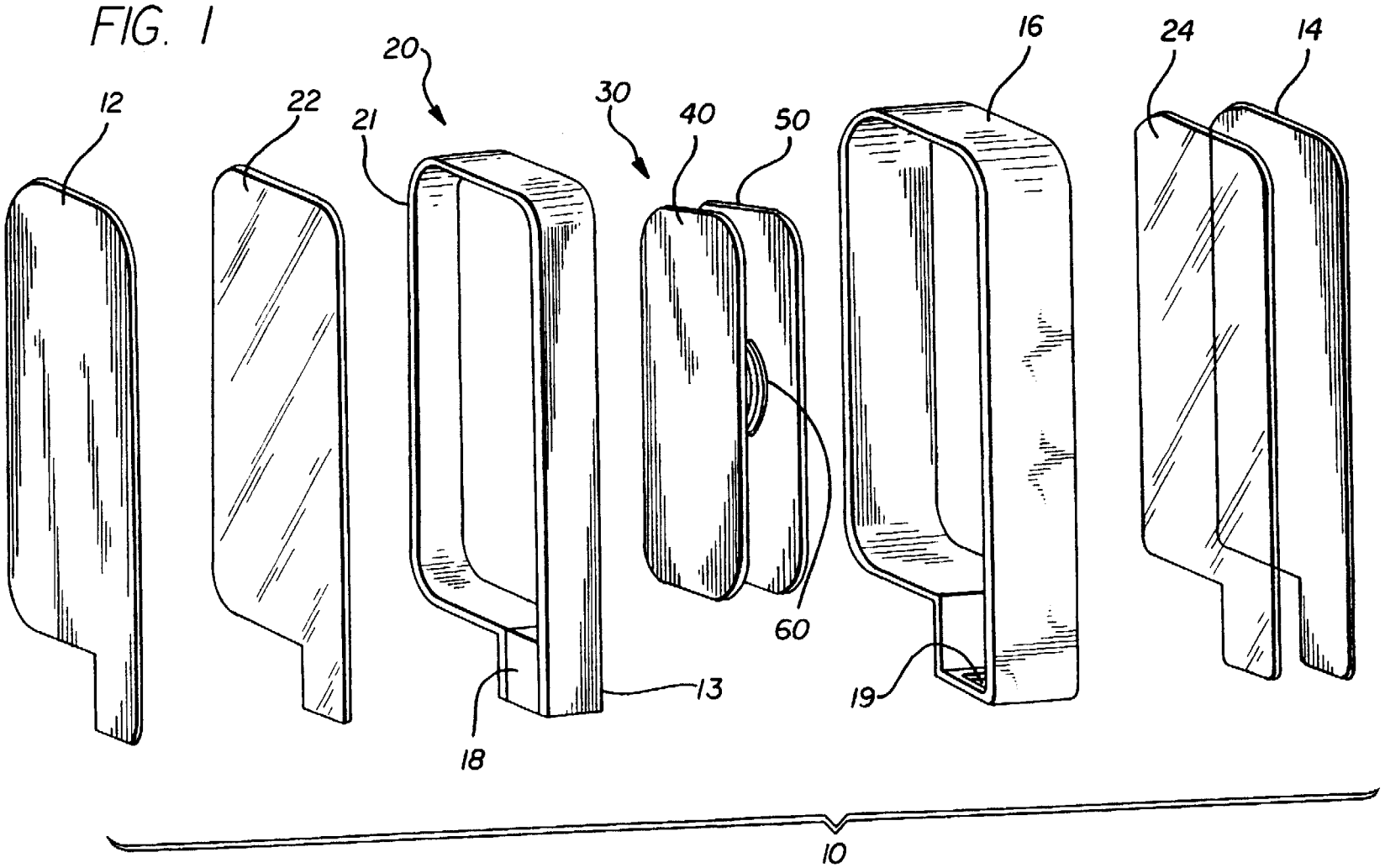
FIG. 1 is an exploded perspective view of a replaceable or throwaway ink cartridge for a thermal inkjet printer containing a collapsible ink reservoir structure.

A replaceable ink cartridge 10 is seen in FIG. 1 to comprise a rigid outer housing having a pair of spaced cover plates 12, 14 intended to be affixed as by cementing to opposite sides of a plastic peripheral wall section 16. Snout portion 13 of the cartridge has an ink discharge aperture in its lowermost end wall (as seen in FIG. 1) to which is affixed an electrically driven print head, not shown.

Figure 2:
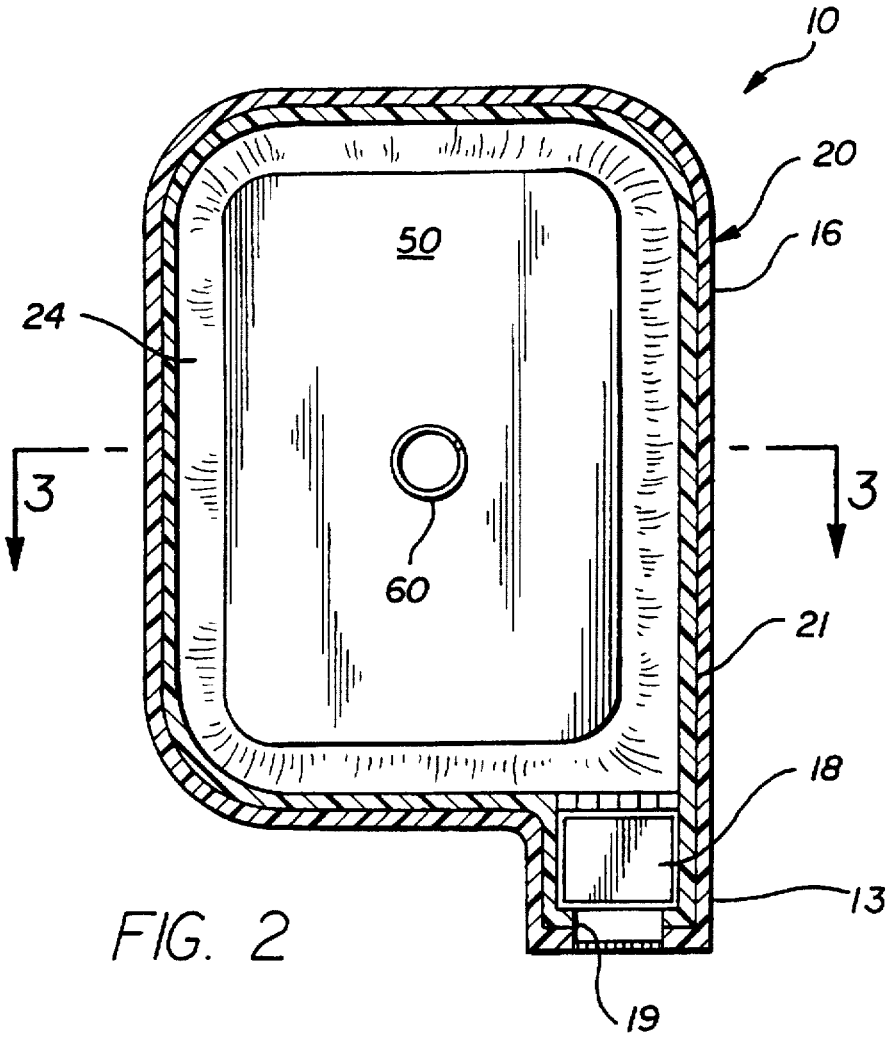
FIG. 2 is a vertical cross section of the cartridge of FIG. 1.

A reservoir structure unit comprised of a relatively rigid inner plastic frame 20 and flexible ink bag membranes 22, 24 attached thereto is mounted in the outer plastic wall section 16. Alternatively, inner frame 20 can be formed integrally with the outer plastic wall section 16 in an injection molding process. Preferably, frame 20 is formed of a softer and lower melting point plastic than plastic wall section 16 to permit heat bonding of the membranes 22, 24 thereto. Such can be accomplished in a two-step molding process as is well within the skill of a person skilled in the art. Frame 20 may be constructed with some flexibility to assist in mounting it in the housing 10 but is rigid relative to the flexible membranes described below. The frame 20 has a pair of opposite side edges 21 to which a pair of flexible membranes 22, 24 are respectively joined as by heat welding at their peripheral edges to form the reservoir structure. The reservoir structure preferably contains a pressure regulator 30 which in turn is comprised of a pair of spaced substantially parallel plates 40, 50 urged apart by a spring 60 into engagement with the flexible membranes 22, 24. The assembled reservoir structure including the inner frame 20, membranes 22, 24 and pressure regulator 30 is then mounted inside of wall section 16 of the cartridge and side walls 12, 14 are then affixed to the cartridge housing peripheral wall 16. The snout portion 13 of housing 10 also contains an ink filter 18 which is placed in fluid communication with the flexible ink bag reservoir. The filter 18 may be mounted inside the reservoir structure or it can be positioned outside of the reservoir structure but inside outer housing 10 with minor porting and seal modifications to ensure fluid communication from the ink reservoir to the filter 18. The lowermost portion of the peripheral outer housing wall 16 (as viewed in FIG. 1) is provided with an ink discharge aperture 19 (FIG. 2) through which ink is downwardly discharged from the filter 18 to the print head, not shown.

Figure 3:
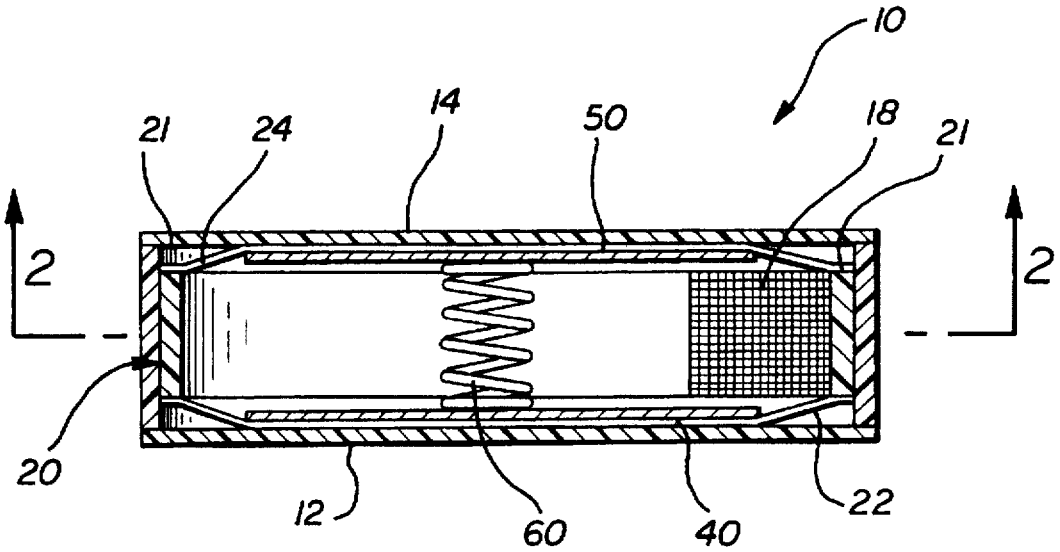
FIG. 3 is a cross sectional plan view of the cartridge of FIG. 1.

The pressure regulator side plates 40, 50, best seen in FIG. 3, are of generally rectangular configuration with rounded corners to avoid damaging the flexible bag membranes 22, 24. Prior to or simultaneous with attachment of the membranes 22, 24 to the sides of inner frame 20, the regulator 30 is placed within the inner frame 20 by collapsing it partially against the spring force such that it initially occupies a prestressed condition inside the ink bag formed by the inner frame 25 and membranes 22, 24. The amount of this prestressing is readily controllable by the designer by selecting the desired degree of compression of the spring 60.

The flexible membranes 22, 24 and the pressure regulator sideplates 40, 50 gradually move towards each other as the reservoir is evacuated of ink. The membranes 22, 24 are sized with enough extra membrane material near their edges of attachment to the inner frame 20 such that they are freely moveable with the side plates between full and empty positions as best indicated in FIG. 3. This permits most of the ink in the reservoir structure 25 to be used before the cartridge is discarded or refilled, as the case may be.

Ideally, both sideplates 40, 50 and the spring 60 are made of a non-corrosive sheet metal such as stainless steel and the inner frame 20 and bag membranes 22, 24 are made of inert plastics which do not react with print ink.

Persons skilled in the art will readily appreciate that various modifications can be made from the preferred embodiment of the invention disclosed herein and that the scope of protection is intended to be defined only by the limitations of the appended claims.

We claim:

1. An ink-jet print cartridge in which ink is maintained under negative pressure, comprising:

a) an ink reservoir;

b) a supply of ink in said ink reservoir;

c) a rigid frame having a pair of peripherally extending edges on opposite sides thereof; said edges lying in spaced planes, and an ink discharge port in said frame between said edges;

d) a first flexible membrane having a peripheral edge sealingly joined to one of said spaced peripheral edges of said frame to provide a first sealed junction which circumscribes an entire perimeter of said ink reservoir; and e) a second flexible membrane, separate from said first membrane, having a peripheral edge sealingly joined to the other of said spaced peripheral edges of said frame to provide a second sealed junction which circumscribes said entire perimeter, there being no direct physical connection between said first membrane and said second membrane, whereby said first and said second membranes have surfaces spaced inwardly from said edges of said membranes which move toward each other as said ink is removed from the reservoir and form, with said frame, said ink reservoir, and said first and second membranes are freely movable between a full position and an empty position.

2. The ink-jet print cartridge structure of claim 1, wherein said spaced edges lie in spaced parallel planes, and further comprising an ink pressure regulator comprised of a pair of spaced substantially parallel flat side plates between said membranes and a spring urging said plates apart from each other into engagement with said membranes.

3. The ink-jet print cartridge of claim 2, wherein said spring is affixed to each of said plates.

4. The ink-jet print cartridge of claim 2, wherein each of said plates is of generally rectangular configuration and has rounded corners.

5. The ink-jet print cartridge of claim 2, further comprising a filter mounted inside of said frame, said filter having an ink discharge orifice aligned with said discharge port of said frame.

6. A printer ink cartridge comprising: a rigid housing containing an ink reservoir structure in which ink is to be maintained under negative pressure, said structure comprising:

a) an ink reservoir;

b) a supply of liquid ink in said reservoir;

c) a rigid frame having a pair of peripherally extending spaced parallel edges on opposite sides thereof, said edges lying in spaced planes, and an ink discharge port in said frame between said planes;

d) a first flexible membrane having a peripheral edge sealingly joined to one of said spaced parallel edges of said frame to provide a first sealed junction which circumscribes an entire perimeter of said ink reservoir; and e) a second flexible membrane, separate from said first membrane, having a peripheral edge sealingly joined to the other of said spaced parallel edges of said frame to provide a second sealed junction which circumscribes said entire perimeter, there being no direct physical connection between said first membrane and said second membrane, said first and said second membranes having surfaces spaced inwardly from said edges of said membranes which move toward each other as ink is removed from the reservoir and form, with said frame, said ink reservoir structure, and said first and second membranes are freely movable between a full position and an empty position.

7. The printer ink cartridge of claim 6, wherein said rigid housing is comprised of a peripheral wall and a pair of spaced cover plates affixed to said wall, said peripheral wall having an Ink discharge opening.

8. The printer ink cartridge of claim 7, wherein aid frame is affixed in the interior of said peripheral wall of said housing.

9. The printer ink cartridge of claim 8, wherein said peripheral wall of said housing has a melting point and wherein said frame has a lower melting point than the melting point of said peripheral wall of said housing.

10. The printer ink cartridge of claim 8, wherein said frame is integrally formed with said peripheral wall of said housing.

11. The printer ink cartridge of claim 8, wherein said spaced edges lie in spaced parallel planes, and further comprising an ink pressure regulator comprised of a pair of spaced substantially parallel flat side plates between said membranes and a spring urging said plates apart from each other into engagement with said membranes.

12. The printer ink cartridge of claim 11, wherein said spring is affixed to each of said plates.

13. The printer ink cartridge of claim 11, wherein each of said side plates is of generally rectangular configuration and has rounded corners.

14. The printer ink cartridge of claim 8, further comprising a filter mounted inside of said frame, said filter having an ink discharge orifice aligned with said discharge port of said frame and said discharge port of said frame is aligned with said discharge opening in said housing wall.

15. The printer ink cartridge of claim 14, wherein said filter is mounted outside said frame inside said cartridge housing, said filter having an ink inlet orifice aligned with said discharge port in said frame and an ink outlet orifice aligned with said discharge opening in said housing wall.

16. The printer ink cartridge of claim 6, further comprising an ink jet printer for using said printer ink cartridge, wherein said printer ink cartridge is replaceably mounted on said ink jet printer.

17. A printer ink cartridge comprising: a rigid housing including a wall containing an ink discharge opening, said housing containing an ink reservoir structure in which ink is to be maintained under negative pressure, said structure comprising:

a) a rigid frame having a pair of peripherally extending spaced parallel edges on opposite sides thereof, said edges lying in spaced planes, and an ink discharge port in said frame between said planes, said frame having a peripheral shape aspect;

b) a first flexible membrane having a peripheral edge sealingly joined to one of said spaced parallel edges of said frame to provide a first sealed junction which circumscribes an entire perimeter of said ink reservoir; and c) a second flexible membrane, separate from said first membrane, having a peripheral edge sealingly joined to the other of said spaced peripheral edges of said frame to provide a second sealed junction which circumscribes said entire perimeter, there being no direct physical connection between said first membrane and said second membrane, said first and said membranes having surfaces spaced inwardly from said edges of said membranes which move toward each other as ink is removed from the reservoir, and wherein said peripheral edges circumscribe an entire perimeter of said ink reservoir, and said first and second membranes are freely movable between a full position and an empty position; and d) a peripheral inner wall surface of said housing and said first and said second membranes forming, with said frame and said peripheral wall surface of said housing, said ink reservoir structure.

18. The printer ink cartridge of claim 17, wherein said frame is affixed in said peripheral wall of said housing when properly positioned within said housing.

19. The printer ink cartridge of claim 18, wherein said spaced edges lie in spaced parallel planes, and further comprising an ink pressure regulator comprised of a pair of spaced substantially parallel flat side plates between said membranes and a spring urging said plates apart from each other into engagement with said membranes.

20. The printer ink cartridge of claim 19, further comprising a filter mounted adjacent said discharge port of said frame, said filter having an ink discharge orifice aligned with said discharge port of said frame.

21. The printer ink cartridge of claim 20, wherein said filter is mounted outside said frame inside said cartridge housing, said filter having an ink inlet orifice aligned with said discharge port in said frame and an ink outlet orifice aligned with said discharge opening in said housing wall.

22. The printer ink cartridge of claim 21, further comprising a supply of liquid ink within said ink reservoir.

23. The ink reservoir of claim 20, wherein said filter is mounted inside of said frame, said filter having an ink discharge orifice aligned with said discharge port of said frame and said discharge opening in said housing.

24. The printer ink cartridge of claim 17, further comprising a supply of liquid ink within said ink reservoir.

* * * * *